US007090078B2

(12) United States Patent
Gits

(10) Patent No.: US 7,090,078 B2
(45) Date of Patent: Aug. 15, 2006

(54) SHIPPING FRAME FOR SECURELY TRANSPORTING AN ENGINE ASSEMBLY

(76) Inventor: Jules C. Gits, 1970 Wexford Cir., Wheaton, IL (US) 60187

( * ) Notice: Subject to any disclaimer, the term of this patent is extended or adjusted under 35 U.S.C. 154(b) by 286 days.

(21) Appl. No.: 10/261,746

(22) Filed: Oct. 1, 2002

(65) Prior Publication Data

US 2004/0060835 A1 Apr. 1, 2004

(51) Int. Cl.
*B65D 19/00* (2006.01)
*B65D 85/58* (2006.01)
*B65D 6/16* (2006.01)

(52) U.S. Cl. ..... 206/386; 206/503; 206/319; 206/485; 220/4.28; 108/53.1

(58) Field of Classification Search ..... 206/503, 206/319, 320, 509, 600, 386, 599, 511; 220/4.28; 108/53.1, 55.1, 55.3, 56.1
See application file for complete search history.

(56) References Cited

U.S. PATENT DOCUMENTS

| | | | | | |
|---|---|---|---|---|---|
| 2,990,951 | A | * | 7/1961 | Fallert | 206/597 |
| 3,384,228 | A | * | 5/1968 | Cannon | 206/485 |
| 3,797,691 | A | * | 3/1974 | Williams, Jr. | 220/1.5 |
| 4,027,794 | A | * | 6/1977 | Olson | 206/395 |
| RE29,415 | E | * | 9/1977 | Ricobene et al. | 206/550 |
| 4,756,413 | A | | 7/1988 | Gits | |
| 4,936,451 | A | * | 6/1990 | Shuert | 206/386 |
| 5,029,734 | A | * | 7/1991 | Nichols | 222/105 |
| 5,109,985 | A | * | 5/1992 | Rose | 206/600 |
| 5,123,541 | A | * | 6/1992 | Giannini et al. | 206/600 |
| 5,133,460 | A | * | 7/1992 | Shuert | 206/600 |
| 5,154,286 | A | | 10/1992 | Gits | |
| 5,358,137 | A | * | 10/1994 | Shuert et al. | 220/485 |
| 5,433,322 | A | * | 7/1995 | Williams | 206/443 |
| 5,564,599 | A | * | 10/1996 | Barber et al. | 222/105 |
| 5,651,463 | A | * | 7/1997 | Major et al. | 206/599 |
| 5,722,328 | A | * | 3/1998 | Darby | 108/55.1 |
| 5,829,595 | A | * | 11/1998 | Brown et al. | 206/600 |
| 6,024,223 | A | * | 2/2000 | Ritter | 206/600 |
| 6,622,641 | B1 | * | 9/2003 | Smyers | 108/56.1 |

* cited by examiner

*Primary Examiner*—Jila M. Mohandesi
(74) *Attorney, Agent, or Firm*—Wallenstein & Wagner, Ltd.

(57) ABSTRACT

A shipping frame assembly for transporting an object. The shipping frame assembly has at least one pallet adapted to receive the object and at least one coupling member removably mounted to the pallet, for securing the object to the pallet. The pallet includes a support member, which has at least one first cut-out portion. The coupling member has at least one second cut-out portion. When the coupling member is mounted to the pallet, the first cut out portion and second cut portion cooperatively form an aperture adapted to securely fasten the object to the pallet.

11 Claims, 4 Drawing Sheets

SHIPPING FRAME FOR SECURELY TRANSPORTING AN ENGINE ASSEMBLY

FIELD OF THE INVENTION

The present invention pertains to a shipping frame assembly for transporting objects. More particularly, the present invention pertains to a shipping frame assembly having an adaptable pallet arrangement configured for securely fasten engines to the shipping frame.

BACKGROUND OF THE INVENTION

Shipping frames used to transport engine assemblies and other similar objects are generally known in the art. Typical shipping frames use a wide variety of packing materials such as Styrofoam, plastic, and cardboard to secure and protect the object from damage during transport. While these packing materials are generally effective, they are also costly. Furthermore, proper packing of the frame with these materials can be time consuming, and therefore also costly.

When transporting an engine assembly, it is vital that the engine be firmly secured to the shipping frame, to protect the engine from damage. Some shipping frame assemblies require that the engine is mounted in a generally vertical position, or at least that the crankshaft is inserted vertically into an aperture in the pallet. The disadvantage of such assemblies are that they do not provide a stable connection with the engine sufficient to prevent the engine from becoming dislodged or damaged during transport, unless large amounts of packing materials are used.

U.S. Pat. No. 5,154,286 to Gits discloses a reusable shipping frame used for packing large, heavy materials. The reusable shipping frame provides a frame for securing generally heavy manufactured goods. U.S. Pat. No. 4,756,413 to Gits discloses a frame for shipping large, heavy manufactured goods, as well. U.S. Pat. Nos. 5,154,286 and 4,756,413 were both invented by the inventor of the present patent application, and are incorporated herein by reference. While the above mentioned shipping frame assemblies are suitable for their intended purposes, it is desirable to provide a shipping frame assembly configured to securely mount a plurality of engines for transport, while significantly reducing the amount of packing materials used.

Accordingly, the present invention provides a shipping frame assembly with a fastening pallet arrangement to securely fasten a plurality of engines or other objects within the frame. The arrangement provides stackable pallets which can be (1) mounted to coupling members to form the shipping frame or; (2) mounted on each other, when empty to permit compact shipping of the pallets back to the shipper for reuse. Another advantage of this new shipping frame is that it provides a structure for securing one or more engines in a manner such that most, if not all, Styrofoam and cardboard can be eliminated, reducing the cost and time required for packing.

SUMMARY OF THE INVENTION

A shipping frame assembly for transporting an object. The object has an engaging member, such as a crankshaft, enabling the object to be secured within the shipping frame assembly. According to one aspect of the invention, the shipping frame assembly comprises at least one adaptable pallet, adapted to receive the object, and at least one coupling member removably mounted to the pallet, for securing the engaging member to the pallet.

According to another aspect of the invention, the pallet includes at least one support member. The support member has at least one first cut out portion, and the coupling member has at least one second cut out portion. When the coupling member is mounted to the pallet, the first cut out portion and second cut portion cooperatively form an aperture adapted to securely fasten the engaging member to the pallet.

According to another aspect of the invention, the pallet includes a slot adapted to receive a stud member. The coupling member includes at least one stud member adapted for engaging the slot. The stud member extends from a lower portion of the coupling member into the slot, securely mounting the coupling member to the pallet.

According to another aspect of the invention, another stud member extends from an upper portion of the coupling member, securely mounting the coupling member to a second pallet.

According to another aspect of the invention, the shipping frame assembly includes at least one base member removably attachable to the pallet. The base member includes at least one stud member adapted for insertion into a slot. The slot is positioned at a lower portion of the pallet, enabling the base member to be attached to this lower portion.

In another aspect of the invention, the support member has a plurality of first cut out portions and the coupling member has a plurality of second cut out portions. The support member and coupling member are mounted such that each first cut out portions is aligned with a corresponding second cut out portion, forming a plurality of apertures. Each aperture is adapted to individually secure an object to the pallet.

Another aspect of the invention comprises a shipping frame assembly that includes a plurality of coupling members and a plurality of support members. Each individual coupling member is removably mountable to a corresponding support member, enabling a plurality of objects to be secured within the shipping frame.

The shipping frame assembly may have at least one stabilizing member with an engaging surface configured for engagement with an engine. The pallet has a recess formed in a lower portion of the pallet adapted to secure the stabilizing member to the pallet.

These and other objects and advantages will be made apparent from the following description of the drawings, and from the detailed description of the invention.

DETAILED DESCRIPTION OF THE DRAWINGS

This invention is susceptible of embodiments in many different forms. The drawings and descriptions of this application show only the preferred embodiment of the invention. The present disclosure is considered to be an example of the principles of the invention. It is not intended to limit the broad aspect of the invention to the illustrated embodiments.

Figure 1:
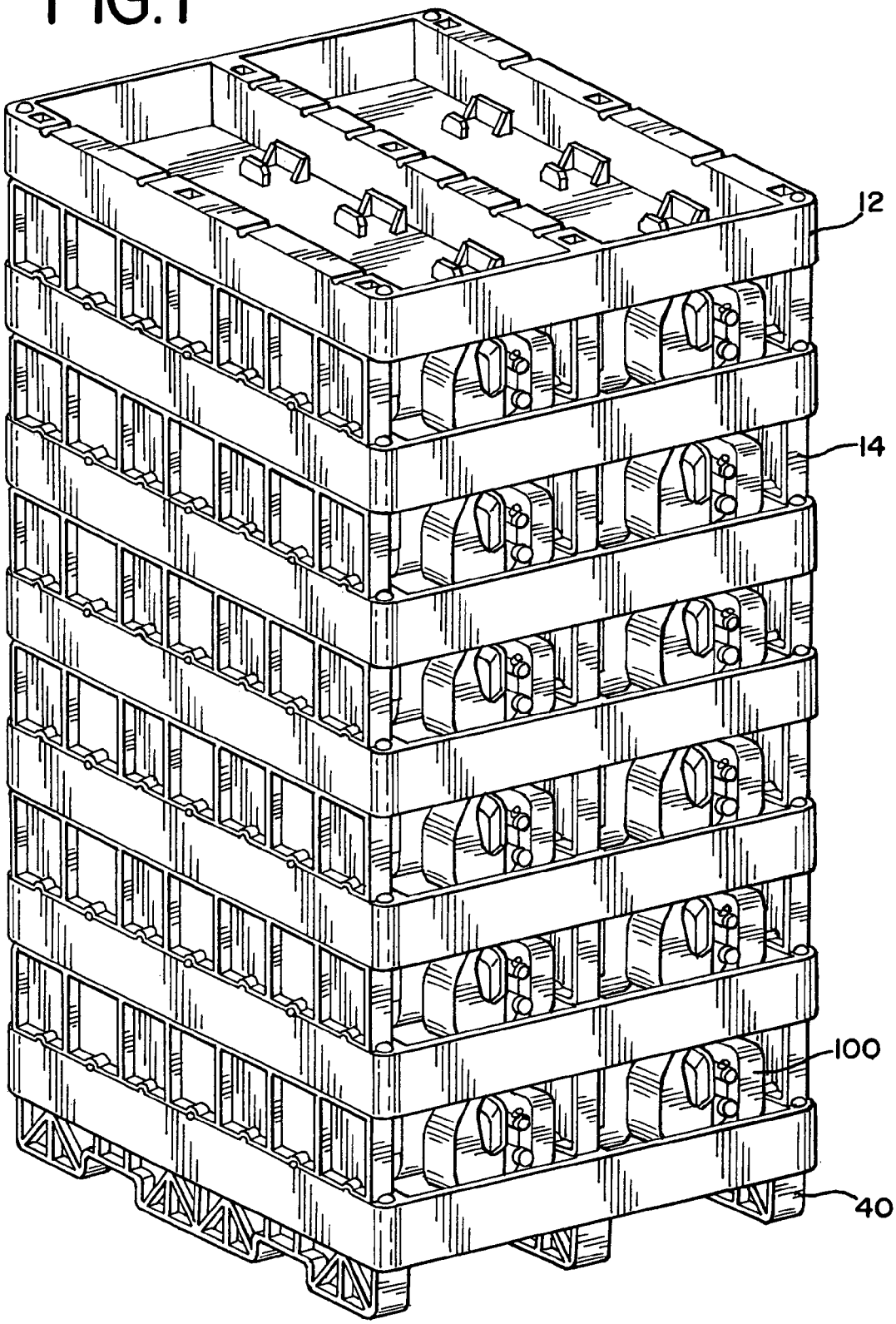
FIG. 1 is a perspective view of the shipping frame assembly in accordance with one embodiment of the present invention.

Referring now to the drawings, and particularly FIG. 1, there is shown an exemplary shipping frame assembly 10, in accordance with one embodiment of the present invention. The shipping frame assembly 10 is configured to secure many mounted engine assemblies 100 or similar objects to the frame 10, enabling the engines 100 to be safely stored, and especially to be safely transported. The shipping frame assembly 10 includes one or more adaptable pallets 12, and one or more coupling members 14, configured to be coupled to each other to form an integral frame structure.

The pallet 12 is adapted to receive and support one or more engine assemblies 100. The engine 100 or other object generally includes a engaging member 102 or surface. In the present embodiment, the engaging member 102 is the crankshaft, which extends generally outwardly from the engine body. The pallet 12 includes a horizontal base 16 having a generally planar configuration, including an upper surface 18 and a lower surface 20.

The pallet 12 further includes an integral support member 22 or wall secured to its upper surface 18. In the present embodiment, the support member 22 is integrally formed with the pallet 12. However, the support member 22 can also be removably attached to the pallet 12.

The support member 22 is formed to engage a portion of the engine 100. Particularly, the support member 22 includes one or more openings or first cut-out portions 24 formed upon the support member 22. In the disclosed embodiment, the first cut-out portion 24 has a generally semi-circular configuration, adapted to receive a cylindrical or circular engaging member 102 or crankshaft. However, it is understood that the first cut-out portion 24 can have virtually any shape or configuration.

The first cut-out portions 24 are positioned in a spaced-apart relationship to enable each portion 24 to receive a corresponding engaging member 102. In this manner, as can be seen in FIG. 2, many engines 100 can be shipped simultaneously.

Figure 2:
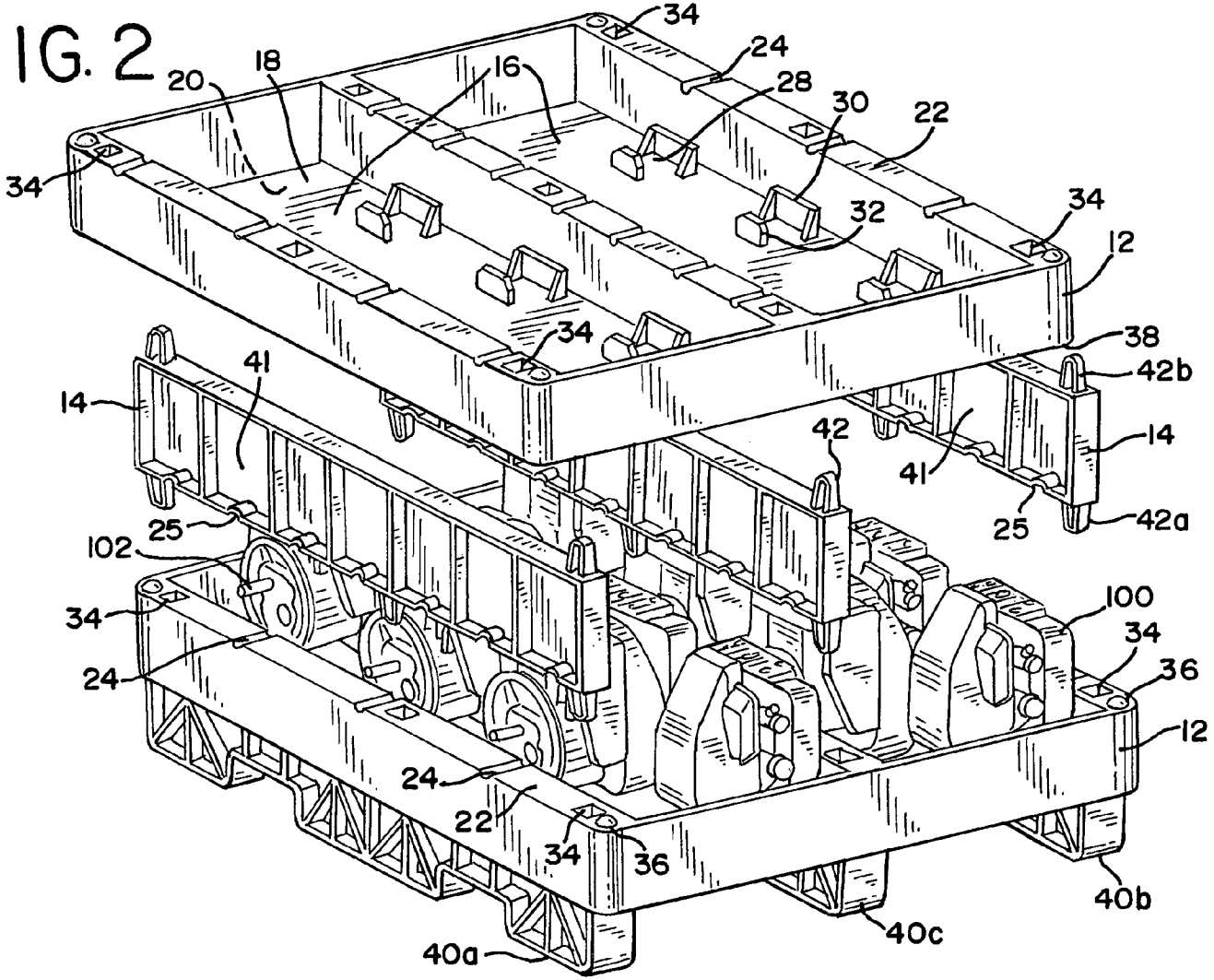
FIG. 2 is an exploded perspective view of the shipping frame assembly.

As may also be seen in FIG. 2, the pallet 12 also includes one or more support brackets 28 mounted on the upper surface 18 of the base 16. The support bracket 28 supports and stabilizes the engine 100. The support bracket 28 includes a first tab 30, and a second tab 32, each configured to engage different parts of the engine 100.

The pallet 12 also includes one or more first openings 34. The openings 34 are adapted to receive stud members 42, extending from the coupling member 14. As may be seen in FIG. 2, these first openings 34 are positioned at the top of the pallet 12. The openings 34 have a generally rectangular-shaped or square-shaped configuration. However, it will be recognized that the openings 34 can have virtually any configuration. In the present embodiment, the openings 34 are spaced apart and aligned to each individually receive a corresponding stud member 42.

The pallet 12 is configured to be removably mounted to another pallet 12. As may also be seen in FIG. 2, the pallet 12 further includes one or more lugs 36 adapted for engagement with a second opening 38 formed in the underside of the above positioned pallet 12. The lug 36 extends generally upward from the top of the pallet 12 or support member 22. When a first upper pallet 12 is mounted on a lower second pallet 12, and both pallets are empty, the lug 36 of the lower pallet 12 engages the opening 38 formed in the upper pallet 12, securing the pallets 12 to each other. In this secured relationship, the two empty pallets 12 take up the least amount of space, which facilitates compact, economical shipping of those pallets.

Coupling member 14 is adapted to be removably mounted to the support member or wall 22 of the pallet 12. The coupling member 14 includes a generally elongated body 41. Preferably, the body 41 of the coupling member 14 has a length substantially equal to the length of the support member 22.

As noted above, the coupling member 14 includes one or more stud members 42 extending from the body 41. The stud members 42 are adapted for secure engagement with an opening 34 formed on the top portion of a first pallet 12, or a similar opening (not shown) in the underside of a second pallet 12. As may be seen in FIG. 2, a first stud member 42*a* extends from a lower portion of the coupling member 14 for insertion into the first opening 34 formed on the pallet 12, enabling the coupling member 14 to be securely mounted to that pallet 12. A stiffening device, such as re-bar (a rigid cylindrical bar), can be inserted into the stud member 42, for added support. In the present embodiment, the coupling member 14 has a plurality of spaced apart first stud members 42*a*, each of which are inserted into spaced-apart openings 34.

A second stud member 42*b* extends from an upper portion of the coupling member 14 for engagement with an opening (not shown) formed in the bottom portion of the adjacent pallet 12, enabling that pallet 12 to be securely mounted to the coupling member 14. In the present embodiment the coupling member 14 has a plurality of spaced-apart second stud members 42*b*, aligned for connection with openings (not shown) formed in the lower portion of the adjacent pallet 12.

The bottom of the coupling member 14 includes one or more second cut-out portions 25. The second cut-out portion 25 is configured to abut against the top of the engaging member 102 or crankshaft. As shown in the drawings, the coupling member 14 can include a plurality of second cut-out portions 25, each configured to abut against separate engaging members 102 or crankshafts.

When the coupling member 14 is mounted to the pallet, the first cut-out portion 24 and second cut-out portion cooperatively 25 form an aperture adapted to secure the crankshaft 102. This ensures tight engagement of the engine 100 to the shipping frame. As shown in the present embodiment, a plurality of first cut-out portions 24 and second cut-out portions 25 are provided, each being configured to together secure a crankshaft 102 to the pallet 12.

Figure 3:
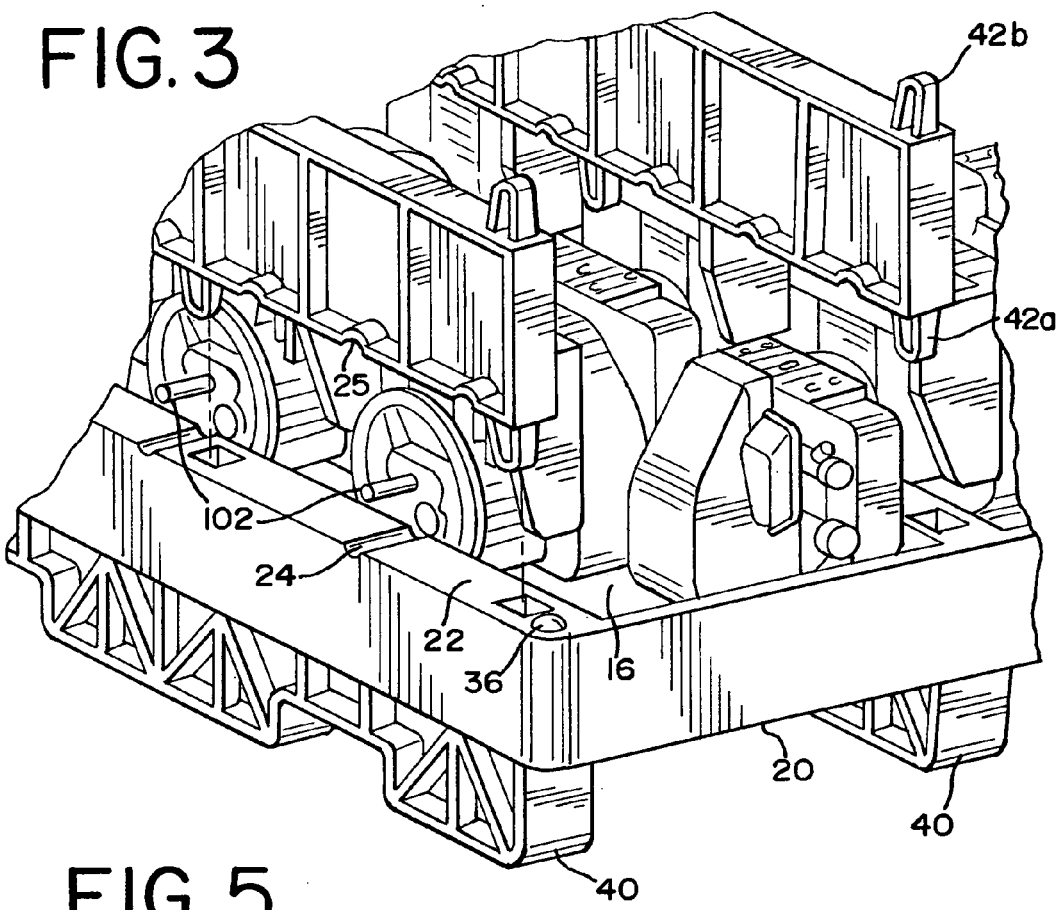
FIG. 3 is an exploded view of a portion of the shipping frame assembly.

As may best be seen in FIGS. 2 and 3, the shipping frame assembly 10 further includes one or more base members 40 configured to be removably attached along the bottom 20 of the pallet 12. The base member 40, when attached to the pallet 12, supports and elevates the shipping frame 10 above the floor. The base member 40 includes one or more stud members (not shown), having a similar configuration to the stud members 42 of the coupling member 14. The stud member extends upwardly from the top of the base member 40. The stud member is adapted for engagement with openings (not shown) formed in the bottom of the pallet.

As shown, three base members 40 are attached to the pallet 12 to provide the frame assembly 10 with elevated support. For example, FIG. 2 is an example of the pallet-base member arrangement. In this arrangement, a first base member 40*a* is connected to one end of the pallet 12, a second base member 40*b* is connected to an opposite end of the pallet 12 and a third intermediate base member 40*c* is connected to the pallet 12 between first base member 40*a* and second base member 40*c*. The base members 40*a–c* are spaced apart, enabling a fork lift to engage the bottom 20 of the pallet 12.

As illustrated, the pallet 12 and coupling member 14 are connected to form an integral shipping frame assembly 10 capable of securely transporting many engines 100. When the engines 100 are mounted on the pallet 12, the support bracket 28 engages the bottom of the engines 100. The crankshaft 102 is received between the first cut-portion 24 and the second cut-out portion 25. In this manner the first cut-out portion 24 and second cut-out portion 25 cooperatively define an aperture, securing the crankshaft 102 between the cut-out portions 24, 25.

As best seen in FIG. 1, the shipping frame assembly 10 is formed by connecting many pallets 12 and coupling members 14 in a stacked formation. In the embodiment of FIG. 1, seven pallets are connected to form the shipping frame assembly 10. Virtually any number of pallets can be stacked to form the frame assembly 10.

Each pallet 12 can secure a plurality of engines 100. In a stacked arrangement, the pallet 12 is mounted to the coupling member 14. Stud member 42*b* (see FIG. 2) engages the opening (not shown) formed in the bottom of pallet 12. When pallets 12 and coupling members 14 are stacked upon each other, the weight of each succeeding the pallet 12 is transferred to the lower pallet through the coupling member 14.

Figure 4:
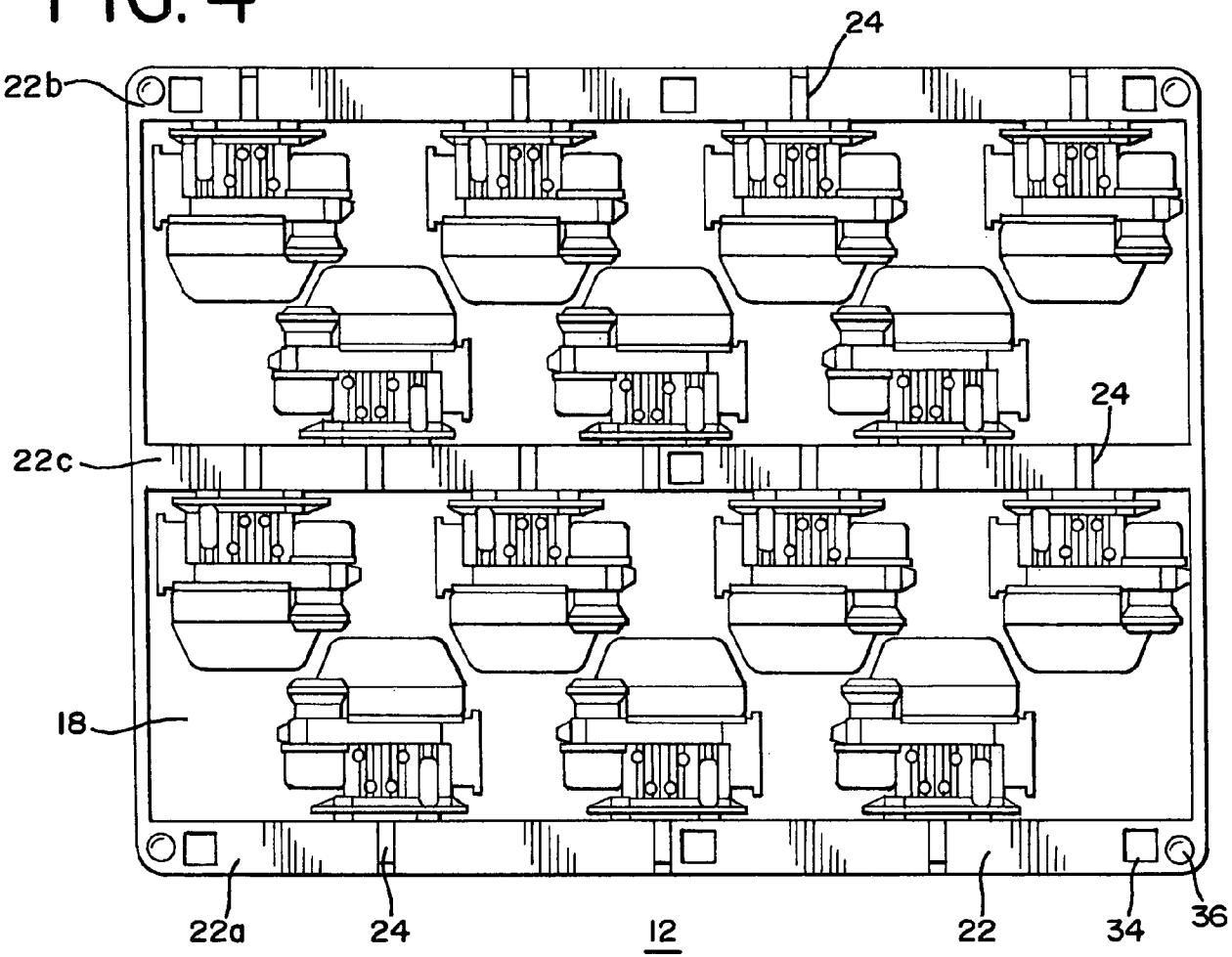
FIG. 4 is a top plan view of a pallet illustrating a plurality of motors in a mounted configuration.

FIG. 4 shows a top view of a pallet 12 configured to secure fourteen engines 100. The pallet 12 includes a first support member 22*a*, a second support member 22*b* and an intermediate third support member 22*c*. The first support member 22*a* is positioned generally adjacent to a first edge of the pallet 12. The second support member 22*b* is positioned generally adjacent to a second edge of the pallet 12. The third support member 22*c* extends along the center of the pallet 12, intermediate the first 22*a* and second members 22*b*.

The first support member 22*a* includes at least three first cut-out portions 24 in a spaced apart relationship, to separately receive the shafts 102 of three engines 100. The second support member 22*b* includes at least four first cut-out portions in a spaced apart relationship, to receive the shafts 102 of four corresponding engines 100. The intermediate member 22*c* provides at least seven cut-out portions 24 enabling the member to secure four engines on one side of member 22*c*, and three engines on the opposite side of member 22*c*.

Figure 5:
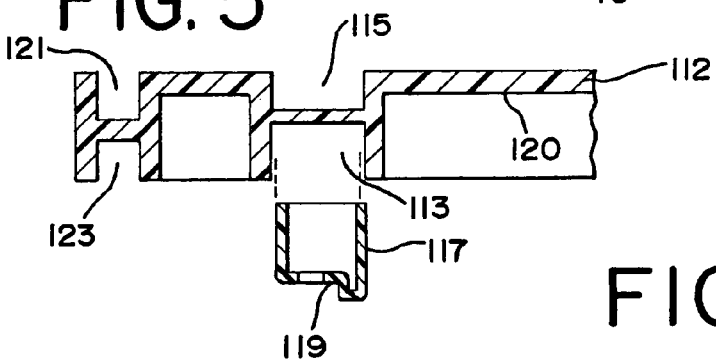
FIG. 5 is a cross-sectional side view of another embodiment of the pallet adapted to receive a hold down stabilizing member; and, FIG. 6 is a cross-sectional side view of plural pallets of FIG. 5, illustrating the pallets in a stacked configuration.
Figure 6:
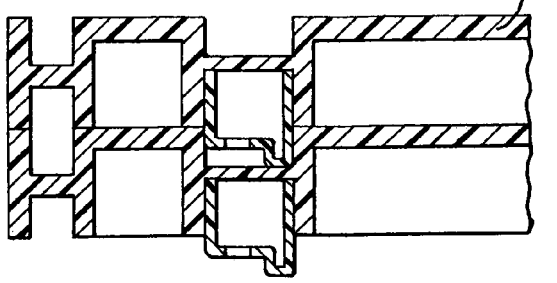

FIGS. 5 and 6 illustrate another aspect of the present invention. In this embodiment, the pallet 112 includes a recess 115 formed on the top of the pallet 112 and a recess 113 formed in the bottom of the pallet 112. The recess 113 is configured to receive the upper end of a stabilizing member 117. The stabilizing member 117 has an engaging surface 119 configured for engagement with an engine 100. The stabilizing member 117, in an inserted position, extends generally downward from the bottom 120 of the pallet 12. Through contact, the engaging surface 119 further stabilizes the engine 100. The stabilizing member 117 may be molded, vacuumed formed, blow molded, injection molded or formed using other methods generally known to those skilled in the art. The stabilizing member 117 can be of any suitable length.

As may also be seen in FIG. 5, the pallet 112 may include a first opening 121 and second opening 123 configured to receive supporting legs of the frame (not shown).

While the specific embodiments have been illustrated and described, numerous modifications can be made which do not significantly depart from the spirit of the invention. The scope of protection is thus only limited by the scope of the following claims.

What is claimed is:

1. A shipping frame assembly for transporting an object, the object having an engaging member enabling the object to be secured within the shipping frame assembly, the shipping frame assembly comprising:

at least one adaptable pallet, the pallet being adapted to receive the object, and at least one generally elongated coupling member removably mountable to the pallet, the coupling member securing the engaging member to the pallet;

wherein the pallet includes at least one support member, the support member having at least one first cut out portion and the coupling member having at least one second cut out portion, the support member including one or more lugs adapted for engagement with an opening formed in the underside of an above-positioned pallet;

wherein when the coupling member is mounted to the pallet, the first cut out portion and second cut out portion cooperatively form an aperture adapted to securely fasten the engaging member to the pallet; and, wherein the pallet includes a slot adapted to receive a stud member, and wherein the stud member extends from the lower portion of the coupling member into said slot for securely mounting the coupling member to the pallet.

2. The shipping frame assembly of claim 1 wherein the coupling member includes at least one stud member adapted for coupled engagement with the slot, the stud member extending from a lower portion of the coupling member into the slot, securely mounting the coupling member to the pallet.

3. The shipping frame assembly of claim 1 wherein the coupling member includes at least one stud member adapted for coupled engagement with the slot, the stud member extending from an upper portion of the coupling member securely mounting the pallet to the coupling member.

4. The shipping frame assembly of claim 1 wherein the coupling member includes at least one stud member extending from a lower portion of the coupling member, securely mounting the coupling member to the pallet, and at least one stud member extending from an upper portion of the coupling member, securely mounting a second pallet to the coupling member.

5. The shipping frame assembly of claim 1 wherein the support member has a plurality of first cut out portions and the coupling member has a plurality of second cut out portions wherein the support member and coupling member are mounted such that each of the first cut out portions are aligned with a corresponding second cut out portion forming a plurality of apertures, each aperture being adapted to individually secure an object to the pallet.

6. The shipping frame assembly of claim 4 further including a plurality of coupling members and a plurality of supporting members wherein each individual coupling member is removably mountable to a corresponding supporting member, enabling a plurality of objects to be secured within the shipping frame.

7. The shipping frame assembly of claim 4 wherein the at least one support member comprises a first support member defining a first outer margin of the pallet, a second support member defining a second outer margin of the pallet, and a third support member positioned intermediate to the first support member and second support member.

8. The shipping frame assembly of claim 7 wherein a first coupling member is mounted to the first support member defining three apertures, a second coupling member is mounted to the intermediate member defining four apertures, and a third coupling member is mounted to the second support member defining three apertures, wherein each aperture is being configured to individually fasten an object.

9. The shipping frame assembly of claim 1 wherein the first cut out portion and the second cut out portion in confronting relation form a generally cylindrical aperture adapted to receive a generally cylindrical engaging member.

10. The shipping frame assembly of claim 1 wherein the object is a motor having a shaft defining the engaging member.

11. A shipping frame assembly for transporting an object, the object having an engaging member enabling the object to be secured within the shipping frame assembly, the shipping frame assembly comprising:

at least one adaptable pallet, the pallet being adapted to receive the object, at least one generally elongated coupling member removably mountable to the pallet, the coupling member securing the engaging member to the pallet, and at least one base member configured to be removably attached to the pallet;

wherein the pallet includes at least one support member, the support member having at least one first cut out portion and the coupling member having at least one second cut out portion, the support member including one or more lugs adapted for engagement with an opening formed in the underside of an above-positioned pallet;

wherein when the coupling member is mounted to the pallet, the first cut out portion and second cut out portion cooperatively form an aperture adapted to securely fasten the engaging member to the pallet; and, wherein the pallet includes a slot adapted to receive a stud member, and wherein the stud member extends from the lower portion.

* * * * *